US010644437B1

(12) United States Patent
Campos et al.

(10) Patent No.: US 10,644,437 B1
(45) Date of Patent: May 5, 2020

(54) CABLE SEAL SYSTEMS AND CONNECTORS

(71) Applicant: TE Connectivity Corporation, Berwyn, PA (US)

(72) Inventors: Tyler Anton Campos, Winston Salem, NC (US); James Oliver Crawford, Greensboro, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/254,478

(22) Filed: Jan. 22, 2019

(51) Int. Cl.
*H01R 13/52* (2006.01)
*H01R 13/631* (2006.01)
*H01R 43/26* (2006.01)

(52) U.S. Cl.
CPC ..... *H01R 13/5221* (2013.01); *H01R 13/631* (2013.01); *H01R 43/26* (2013.01)

(58) Field of Classification Search
CPC ..... H01R 13/5221; H01R 13/5208; H01R 13/5205; H01R 13/631; H01R 43/26
USPC ..... 439/274, 275, 279
See application file for complete search history.

(56) References Cited

U.S. PATENT DOCUMENTS 5,545,854 A * 8/1996 Ishida ..... H02G 3/081 16/2.2
5,857,864 A * 1/1999 Fukuda ..... H01R 13/434 439/275
7,465,192 B2 * 12/2008 McKenzie ..... H01R 13/5208 439/275
2003/0073354 A1 * 4/2003 Hotea ..... H01R 13/18 439/843
2007/0099468 A1 * 5/2007 Wada ..... H01R 13/5205 439/275
2014/0325933 A1 * 11/2014 Marcigot ..... E04G 21/3204 52/741.1
2015/0056859 A1 * 2/2015 Higuchi ..... H01R 13/6473 439/607.41

* cited by examiner

*Primary Examiner* — Gary F Paumen

(57) ABSTRACT

Cable seal systems used with connectors comprise a housing having an inside passage for placement of a cable therein, wherein the passage includes a recessed opening extending axially a distance from a housing open end. A seal member is disposed within the recessed opening and comprises an elastomeric seal element having an inside diameter extending around a cable outside surface and an outside diameter extending around an inside surface of the recessed opening. The inside and outside diameters may have a surface feature to provide a leak-tight seal the respective cable and recessed opening. The seal member includes rigid guide elements that are connected with opposed axial surfaces of the seal element. A cover is connected to the housing open axially fixing placement of the member between the cover and housing, wherein the cover includes an opening to accommodate passage of the cable into the housing.

20 Claims, 11 Drawing Sheets

CABLE SEAL SYSTEMS AND CONNECTORS

FIELD

Cable seal systems and connectors as disclosed herein relate to sealing systems as used with connectors and, more specifically, sealing systems that provide an improved degree of leak resistance to prevent unwanted intrusion of water into the connector.

BACKGROUND

The use of connectors is known for joining together ends of one or more wires, cables and the like that may be used for the purpose of providing a connection or junction for transferring electricity, current or other signals between the connected wires or cables. While such known connectors are generally constructed comprising two connection members configured to complement and attach to one another and also to accommodate the fitment of one or more wires or cables to be connected therein, such known connectors are known to provide a less than desired degree of moisture resistance, especially under use circumstances where the wires or cables running into the connector may be moved around relative to the connector. Failure to provide a desired degree of leak protection may lead to the introduction of moisture into the connector and unwanted corrosion that may compromise the desired electrical connections, or may even lead to an electrical short that may cause damage to the connector and other electrical devices or equipment in electrical communication with the wires or cables. It is, therefore, desired that a cable sealing system be developed for use with connectors that is specially configured to provide an improved degree of leak resistance when placed into an end-use application.

SUMMARY

Cable seal systems as used with connectors as disclosed herein comprise a housing having an inside passage for accommodating placement of a cable therein. In an example, the passage includes a recessed opening extending axially a partial distance inwardly from an open end of the housing. A seal member is disposed within the recessed opening and comprises an elastomeric seal element having an inside diameter and an outside diameter. The seal element inside diameter extends around an outside surface of a cable and the seal element outside diameter extends around an inside surface of the recessed opening. In an example, the seal element outside diameter has a surface feature to provide a leak-tight seal with an adjacent surface of the recessed opening. In an example, the seal element inside diameter has a surface feature to provide a leak-tight seal with an outside diameter surface of the cable. The seal member includes a pair of rigid guide elements that are each positioned adjacent opposed axial surfaces of the seal element. In an example, the seal element axial surfaces include one or more surface features that complement one or more surface features of the respective rigid guide elements to form an attachment fit therebetween. In an example, the guide elements have an annular shape with an inside diameter that is greater than the seal element inside diameter and an outside diameter that is less than the seal element outside diameter.

In an example, a cover is connected with the housing open end. In an example, the seal member is axially interposed between the cover closed end and a section of the housing to axially fix placement of the seal member within the housing. The cover has a closed end with an opening disposed therethough to accommodate passage of the cable into the housing, wherein the cover closed end is positioned adjacent the seal member. In an example, the cover opening has an axial length that extends outwardly a distance beyond the housing open end to stabilize positioning of the cable relative to the seal member. In an example, the cover comprises a first member and a second member that each fit over ½ of the housing open end and that interlock with one another to sandwich the housing therebetween.

Connectors comprising cable seal systems as disclosed herein for joining together two or more cables comprise first and second connector members that are each configured having first ends with complementary surface features to promote interconnection between the connector members. One or more cables are disposed within each of the first and second connectors. One or more of the seal members as disclosed above are disposed within second ends of each connector member. The cover as disclosed above is disposed over each connector member second end and that includes one or more cable openings therethrough that are in axial alignment with the respective one or more cables that are disposed in the one or more seal members. Each seal member is fixed axially within each connector member second end by contact with the cover.

A method for sealing a cable disposed in connector comprises the steps of placing the annular sealing member over an outside diameter of the cable, positioning the combined cable and sealing member in the connector member where the sealing member is disposed adjacent an open end of the connector member, and attaching the cover over the connector member open end to fix axial placement of the sealing member in the connector member.

BRIEF DESCRIPTION OF THE DRAWINGS

Cable seal systems and connectors as disclosed herein will now be described by way of example with reference to the accompanying Figures, of which.

DETAILED DESCRIPTION

Figure 1A:
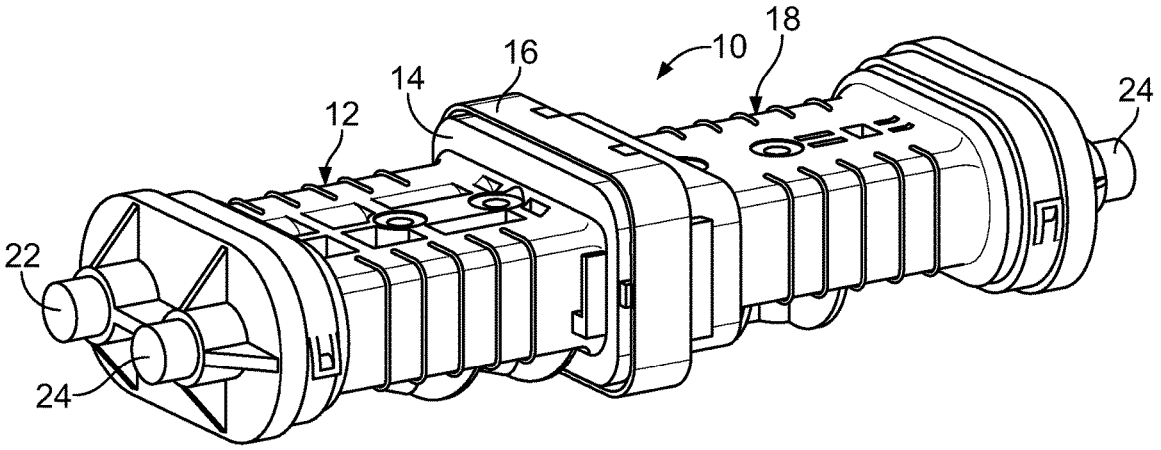
FIGS. 1A to 1C are perspective views of an example embodiment cable seal system and connector as disclosed herein.

Embodiments of cable seal systems and connectors will be described hereinafter in detail with reference to the attached drawings, wherein like reference numerals refer to the like elements. Cable seal systems and connectors as disclosed herein may, however, be embodied in many different forms and should not be construed as being limited to the embodiments set forth herein; rather, these embodiments are provided so that the disclosure will be thorough and complete, and will fully convey the concept of cable seal systems and connectors to those skilled in the art.

Cable seal systems and connectors as disclosed herein generally comprise a pair of connector members each having an end configured to complement and promote attachment with one another, wherein one or more cables or wires are disposed within each connector member such that attachment of the connector members promotes electrical communication between the respective cables and wires. A feature of such cable seal system and connector is that it is configured having a specially engineered seal assembly to ensure a leak-proof connection between the cables entering the connector and each connector member to prevent unwanted intrusion of moisture even in the event of cable movement relative to the respective connector members. A further feature of cable seal systems and connectors as disclosed herein is that the elements of the seal assembly are symmetrical, thereby reducing the cost of manufacture as each element can be used with both connector members, and easing assembly of the elements and the connector.

Figure 1B:
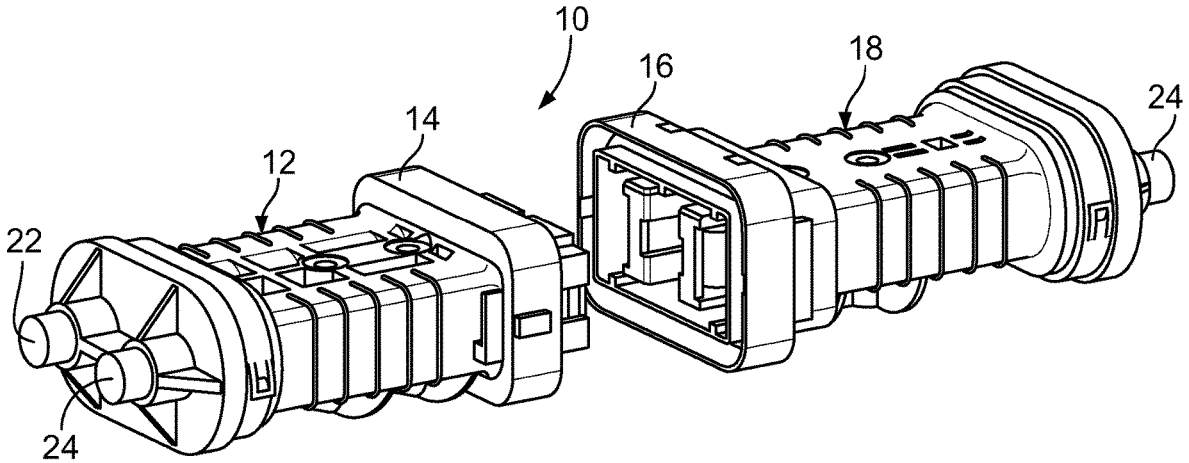
Figure 1C:
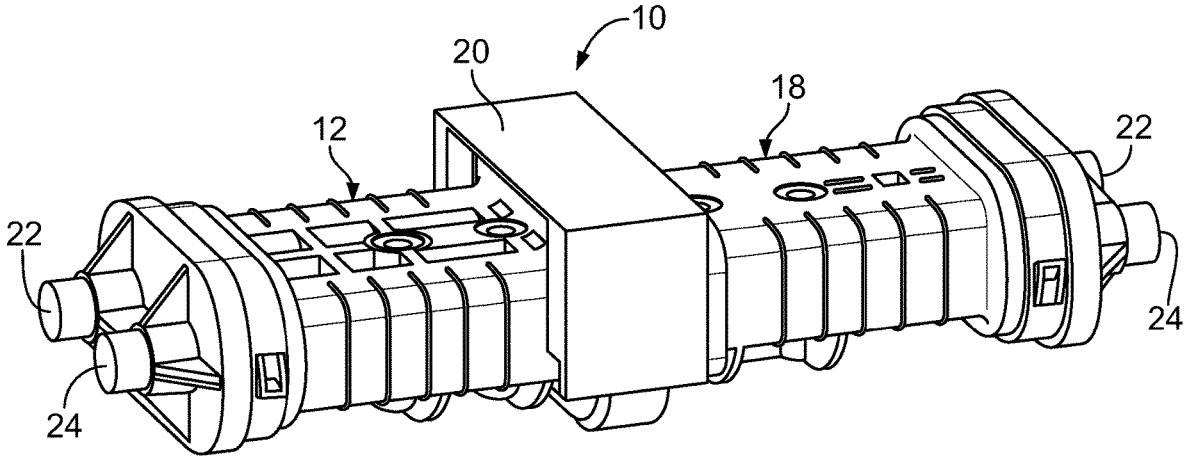

FIGS. 1A to 1C illustrate an example cable seal system and connector 10 as disclosed herein comprising a first connector member or connector housing 12 that is attached at one end 14 to an end 16 of a second connector member or connector housing 18, wherein in this example the end 14 has a male configuration that fits within a female configuration of the end 16. FIG. 1A illustrates the first and second connection members 12 and 18 in a connected state, while FIG. 1B illustrates the first and second connector members in an unconnected state. FIG. 1C illustrates the first and second connector members in a connected state with placement of a removable retention clip 20 positioned over the junction to maintain connection between the first and second connector members. As will be discussed in greater detail below, each of the first and second connector members 12 and 18 comprise a pair of cables 22 and 24 extending into ends of the connector members opposite respective connector member ends 14 and 16, and a seal assembly that is disposed at each such end to provide both an improved degree of guidance and of the cables into the housing, and to provide a leak-tight seal against moisture entering the connector members from the cable entry point. While the cable seal system and connector has been illustrated and disclosed including a pair of cables, it is to be understood that cable seal systems and connectors may be configured comprising a single cable or more than two cables depending on the particular end-use application and that such variation of embodiment is properly within the scope of this disclosure.

The first and second connector members may be formed from an electrically nonconductive rigid material such as plastic or polymeric material. In an example embodiment, the first and second connector members are formed from PVC which may or may not include a glass filler, and that may be made by a molding process. In an example embodiment, the material used is PVC comprising approximately 30 percent by weight glass filler.

Figure 2:
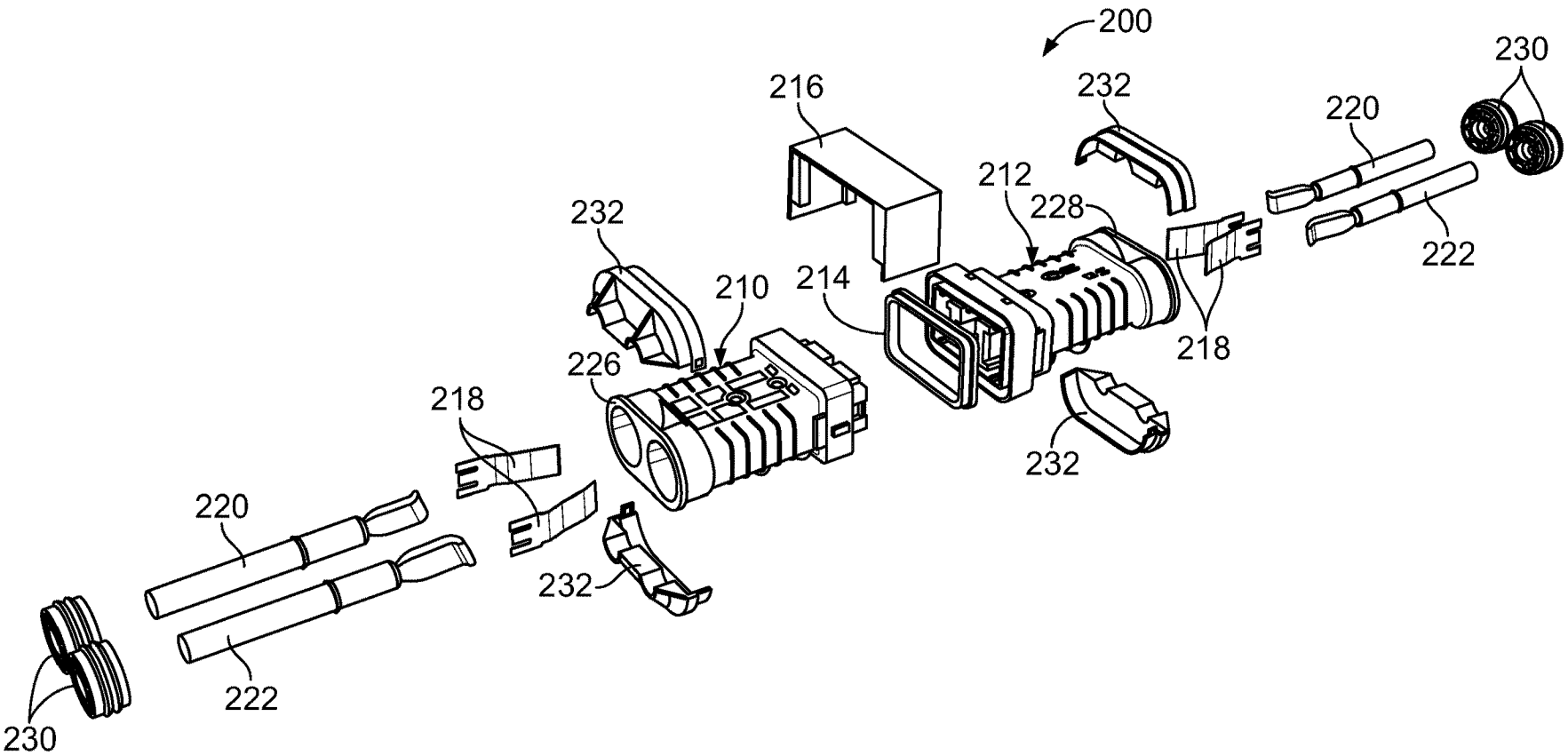
FIG. 2 is perspective view of the example embodiment cable seal system and connector of FIGS. 1A to 1C in an unassembled state.

FIG. 2 illustrates an example cable seal system and connector 200 as disclosed herein in an unassembled state showing the first and second connector members 210 and 212 with a peripheral seal 214 that may be optionally interposed between the mating ends of the connector members, and an optional retention clip 216 that may be disposed over the mating ends of the connector members as noted above. The peripheral seal may be made from an elastomeric material such as rubber, synthetic rubber, or other polymeric material. In an example, the material is silicone rubber. Retaining springs 218 are disposed within each of the first and second connector members and operate to impose a biasing force on ends of the cables adjacent the mating ends of the connector members and will be discussed in greater detail below. A pair of cables 220 and 222 are shown that are disposed within ends of the respective first and second connector members 210 and 212, and are illustrated having terminals attached at cable ends, e.g., in this embodiment crimped spade terminals, to facilitate connection with one another at the junction between the first and second connector members. A cable seal assembly is illustrated and comprises ends 226 and 228 of the first and second connector members where the cables 220 and 222 are disposed, seal members 230 that are disposed concentrically around each of the cables and positioned within the first and second connector member ends 226 and 228, and retention covers 232 that are connected with the first and second connection member ends 226 and 228.

Cable seal systems and connectors as disclosed herein are intended to be used with a variety of differently configured and sized wires or cables. For example, such cables or wires may comprise a single wire or a bundle of wires disposed within an outer sheath. The cables or wires may have a circular outer shape or may have an elliptical outer shape, e.g., due to the bundling of two or more wires therein. In an example, the size of such cables or wires may be larger than about 10 gauge.

Figure 3:
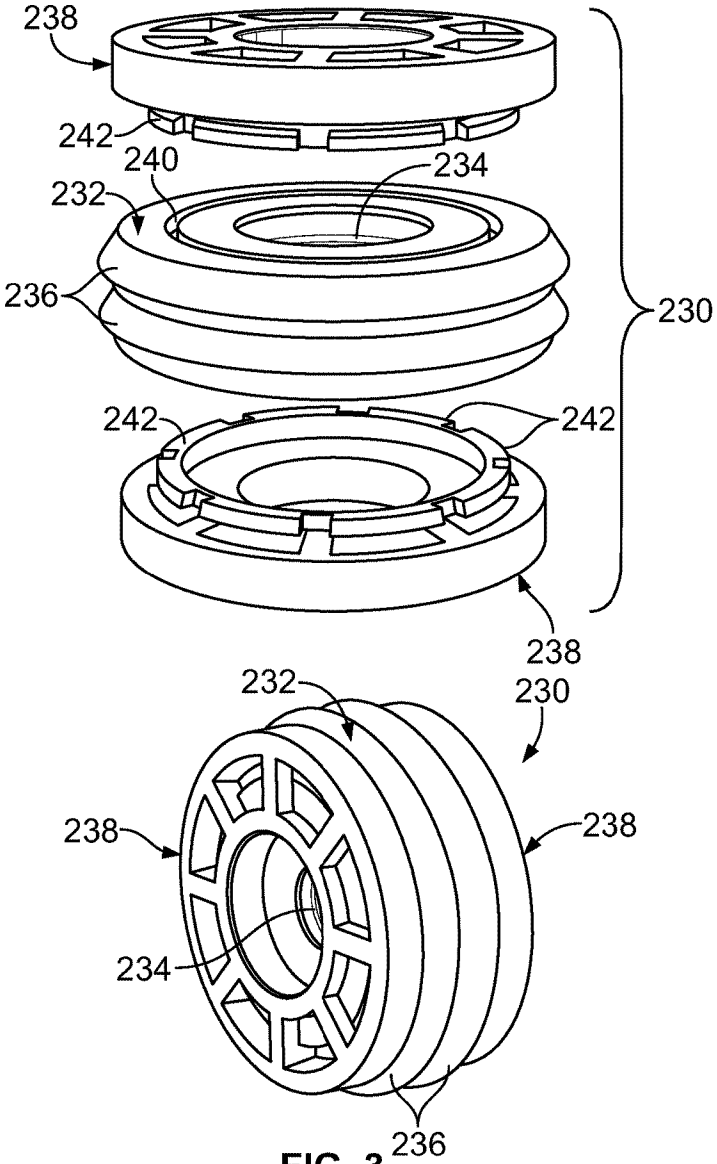
FIG. 3 is a perspective view of an example sealing member of the cable seal system and connector as disclosed herein.
Figure 5:
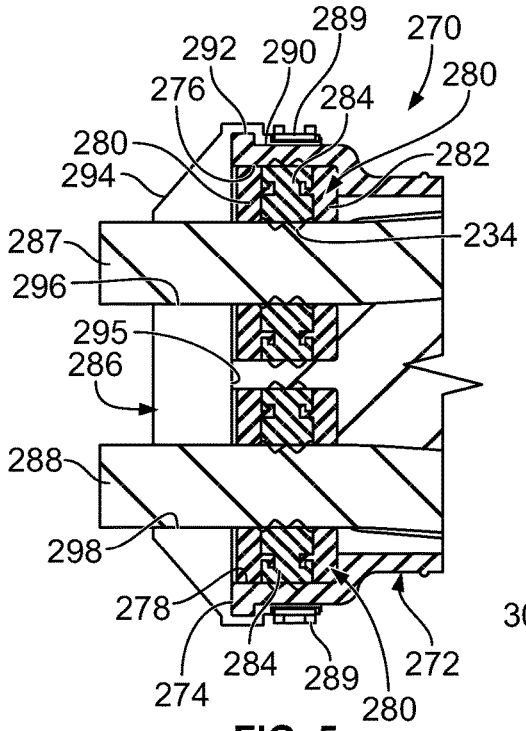
FIG. 5 is a cross-sectional schematic view of an end of an example connector member of the cable seal system and connector as disclosed herein.

FIG. 3 illustrates the seal member 230 in both an assembled and unassembled state as comprising an annular elastomeric seal element 232 having an inside diameter sized to fit over the outside diameter of the cable, and having an outside diameter sized to fit within a recessed opening of the connector member end (as best shown in FIG. 5). In an example embodiment, the seal element 232 may be formed from elastomeric materials having a desired durometer to both provide sufficient deformation to provide leak-tight seals at its inside and outside diameter surfaces while being strong enough to enable attachment with guide elements as discussed below. In an example, the seal element may be formed from elastomeric materials that include rubber, polymeric materials, synthetic rubber or the like, and that have a durometer of greater than about 10, and in the range of from about 30 to 70, and preferably in the range of from about 40 to 60. In an example embodiment, the seal element is formed from silicone rubber.

The seal element 232 may include one or more surface features along either one or both of the inside and outside diameter surfaces for the purpose of providing a leak-tight fit against respective cable and housing surfaces. In an example embodiment, the seal element includes an inside diameter surface comprising a pair of projections 234 (as best shown in FIG. 5) extending inwardly towards the cable outside diameter that each project a desired distance and that are spaced apart axially a desired distance to provide a double barrier against moisture entering between the seal element and cable interface. In an example, the pair of projections 234 each project a distance of from about 2 to 4 mm from the inside diameter surface and are spaced apart a distance of from about 0.5 to 1.5 mm. In an example embodiment, the seal element 232 includes an outside diameter surface comprising a pair of projections 236 extending outwardly towards a surface of the connector member recessed opening that each project a desired distance and that are spaced apart axially a desired distance to provide a double barrier against moisture entering between the seal element and connector member. In an example, the pair of projections 236 each project a distance of from about 0.5 to 1.5 mm from the outside diameter surface and are spaced apart a distance of from about 2 to 3 mm.

While the surface features of the seal element inside and outside diameter surfaces have been described as being in the form of a pair of projections, it is to be understood that such surface feature may in the form of a single projection or more than two projections. Further, it is to be understood that the surface feature may be provided in a form other than projection as long as the surface feature operates to provide a leak-tight seal along the seal element inside and outside diameter surfaces.

The seal member 230 includes a pair of guide elements 238 that are positioned at opposed axial ends of the seal element 232. In an example embodiment, the guide elements 238 are configured identically and have an annular shape that complements the seal element. In an example, the guide elements 238 are configured having one or more surface features that facilitate attachment with respective axial surfaces of the seal element. In an example, the seal element 232 axial surfaces include one or more recesses or groves 240 that is configured to accommodate placement of one or more projections or tongues 242 extending from guide element. In an example embodiment, the guide elements 238 may include lanced surface features that operate to provide a snap attachment with opposed axial surfaces of the seal element 232. The guide elements have an inside diameter sized slightly larger than the outside diameter of the cable so as to provide an interference fit therewith when the cable is disposed through the seal member 230, and are formed from a rigid material, both acting to guide and axially stabilize placement of the cable within the seal member 230. Additionally, the guide elements operate to impose a desired degree rigidity to the seal element and sealing member to stabilize axial placement of the cable therein when the sealing element is installed in the connector member. The guide elements also provide a degree of radial rigidity to the seal element so as to maintain the desired leak-tight interface at both the seal element inside and outside diameters. In an example embodiment, the cable guides can be made from rigid materials such as plastics, polymers, and the like. In an example, the cable guides are formed from PVC that may include a glass filler. In a particular example, the cable guides are formed from PVC comprising of approximately 30 percent by weight glass filler. A feature of such seal member construction, comprising the seal element and guide elements, is that such elements are attached to one another in the manner described without introducing any additional potential leak paths.

Figure 4:
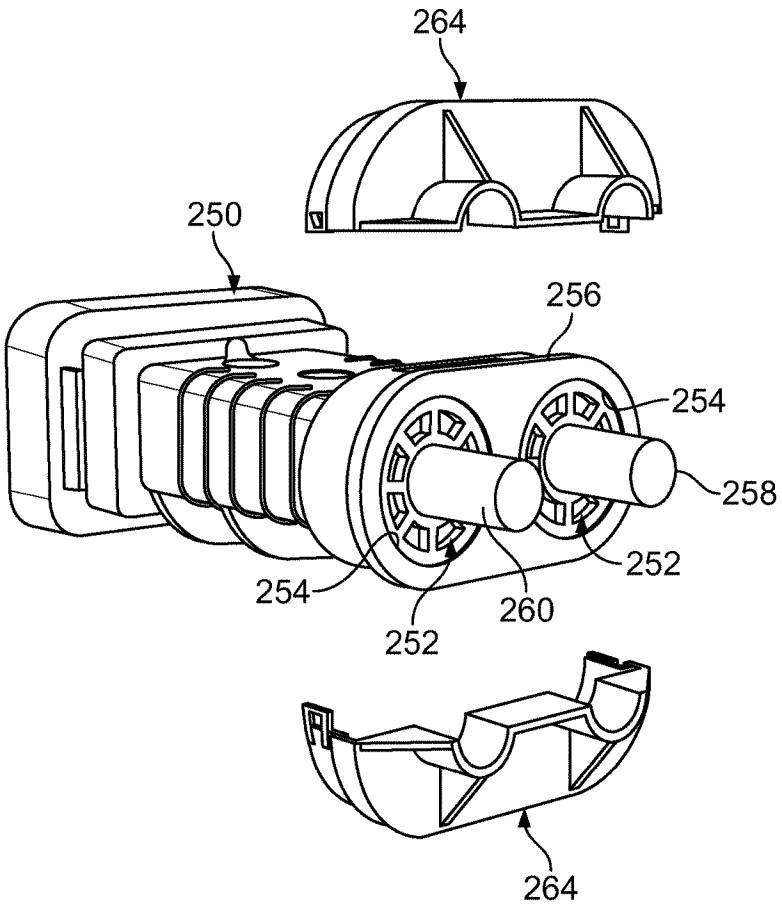
FIG. 4 is a perspective view of an example connector member of the cable seal system and connector as disclosed herein.

FIG. 4 illustrates an example connector member 250 with both seal members 252 disposed within respective recessed openings 254 at the connector member end 256, and the cables 258 and 260 disposed through respective seal members 252. As noted above, the visible portion of the sealing members as illustrated are the outermost guide elements 262. Retention covers 264 are shown in an unassembled position above and below the connector member end 256, and are positioned over respective surfaces of the connector member end 256 to sandwich the connector member therebetween as well as the cables 258 and 260 to add a further degree of cable placement stabilization upstream of the seal member 230 to thereby facilitate providing a leak-tight seal between the cable and connector member, and to reduce unwanted strain on the cable before entering the connector member. The retention covers may be formed from a rigid material such as plastic, or other polymeric material. In an example, retention covers are formed from PVC that may include a glass filler. In a particular example, the retention covers are formed from PVC comprising of approximately 30 percent by weight glass filler.

FIG. 5 illustrates in cross section an example seal assembly 270 as disclosed herein as disposed within a connector member 272. The connector member end 274 comprises first and second recessed openings 276 and 278 that are each configured to accommodate placement of a seal member 280 therein. In an example, the recessed openings have a circular shape with an inside diameter that is slightly larger than the seal member guide element 282 outside diameter, and that is slightly smaller than the pair of projections extending outwardly from outside diameter of the seal element 284. Configured in this manner, placement of the seal member in the recessed opening imposes a radial force on the seal element projections to form a desired leak-tight seal with the connector member 272. The recessed openings have an axial depth, defined by shoulders in the connector that extend to a reduced diameter section, that is slightly more than the axial thickness of the sealing members to accommodate complete placement of the sealing members therein so axial movement of the sealing members are restricted and to enable placement of the retention cover 286 over the connector member end 274 without obstruction.

The cables 287 and 288 are disposed through respective sealing members 280 and a leak-tight seal between the sealing member and the cable is formed by a radial force imposed between the cable outside diameter and the pair of projections extending from the inside diameter of the seal element 284. As illustrated, as the cables extend through the sealing members, the guide elements 282 contact the cable to stabilize the cable with the sealing member both before and after the seal element 284. The retention cover 286 includes a front section 289 that is attached around an outside surface 290 of the connector member a distance away from the end 274 and that extends over an outwardly flared surface 292 at the end 274, and a second section 294 that extends outwardly a desired distance beyond the end and that is configured having a closed end 295 and openings or cylindrical recesses 296 and 298 disposed therein configured to accommodate placement of the cables 287 and 288. In an example embodiment, the retention cover openings extend a length away from the connector member end 272 to further stabilize the cable from external movement prior to entering the sealing members for strain relief and leak-tight enhancement.

Figure 6A:
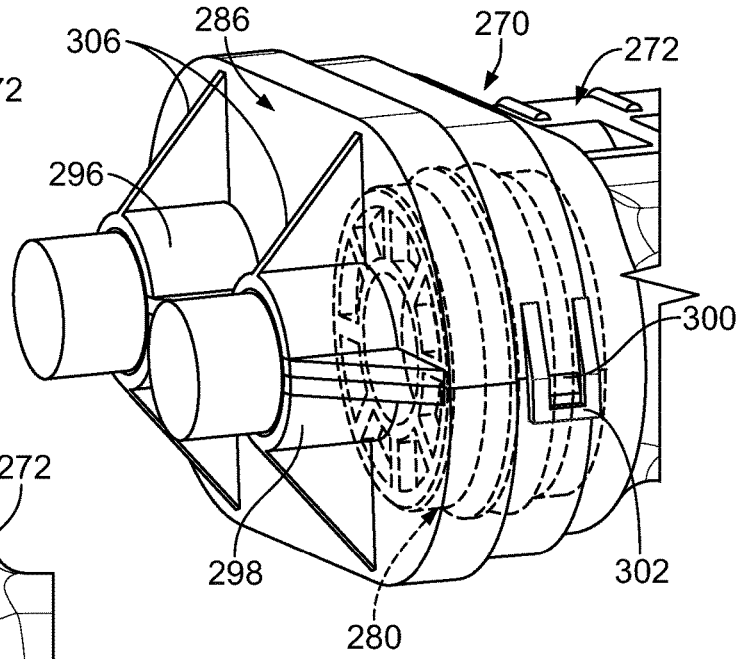
FIGS. 6A and 6B are respective perspective and side views of an example connector member of the cable seal system and connector as disclosed herein.
Figure 6B:
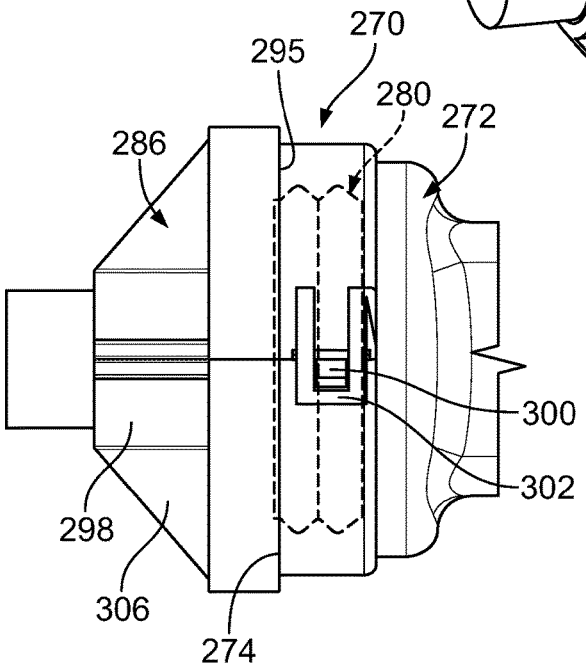

FIGS. 6A and 6B illustrate different views of the sealing assembly 270 as disposed within the connector member 272, and in particular the placement position of the seal member 280 relative to the connector member and the retention cover 286. Also illustrated is the attachment between opposed retention covers 286. In an example embodiment, the retention covers are all configured identically, and include complementary surface features that cooperate together to form a releasable attachment therebetween so that only one part need be made. In an example embodiment, each retention cover includes a male latch surface feature 300 on one connecting end and a female latch surface feature 302 on its other connecting end. In an example embodiment, the retention cover 286 is configured comprising the closed end or wall section 295 positioned at the connector member end 274 that abuts the sealing members 280, and has an outside surface that includes one or more ribs 306 extending from the wall section to the cylindrical recesses 296 and 298 to provide mechanical support thereto.

Figure 7:
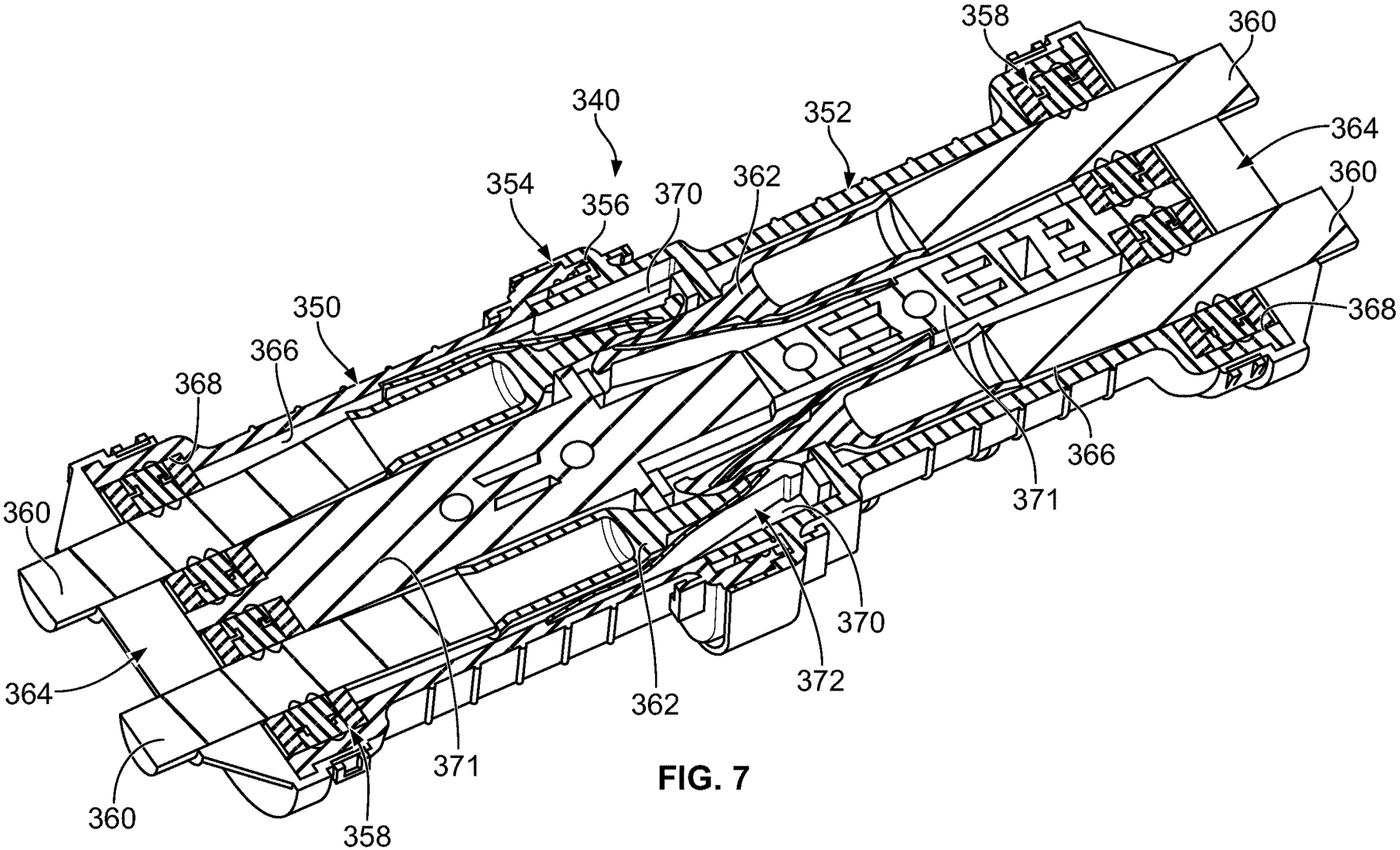
FIG. 7 is a perspective cross-sectional view of an example cable seal system and connector as disclosed herein.

FIG. 7 illustrates in cross section an example embodiment of a cable seal system and connector 340 as disclosed herein comprising first and second connector members 350 and 352 that are joined together at junction 354, wherein a peripheral seal 356 is interposed between the two connector members at the junction. This figure expands on what was illustrated in FIG. 5 with respect to the placement position of the seal members 358 and cables 360 within each of the connector members 350 and 352. Specifically, this figure illustrates the placement position of the cables within the respective connector members downstream from the seal members 358. In an example, the cable ends are fitted with a terminal 362, e.g., a spade terminal or the like, for purposes of connecting with a counterpart cable end in an opposite connector member. Moving away from the retention cover 364 and the seal member 358, each cable is routed in its respective connector member through a reduced diameter section or cable channel 366 extending axially downstream from the recessed openings 368, which reduced diameter section is sized slightly larger than the cable and the terminal to facilitate passage therethrough. The reduced diameter section extends a desired length from the recessed opening so as to maintain approximate axial alignment of the cable therein relative to the seal member, thereby providing guidance and stability to the cable downstream from the seal member and relieving unwanted strain on the cable.

After the reduced diameter section 366, each cable terminal is disposed in a connection port 370 of a respective connector member that is configured to accommodate connection between cable terminals of combined connector members. The cables in each connector member are isolated from one another by a dividing section 371 that is part of the connection member. Retaining springs 372 are disposed in both connector members, and are specially configured to connect with side surfaces of the cable terminals 362 for purposes of imposing a biasing force on the terminal to maintain a desired axial alignment within the connector and also urge the terminal towards a terminal of an opposed cable in a connector member for attachment and electrical connection. As illustrated, in an example, the retaining springs extend from a portion of the reduced diameter section 366 into a portion of the connection port 370, and are discussed in greater detail below.

Figure 8:
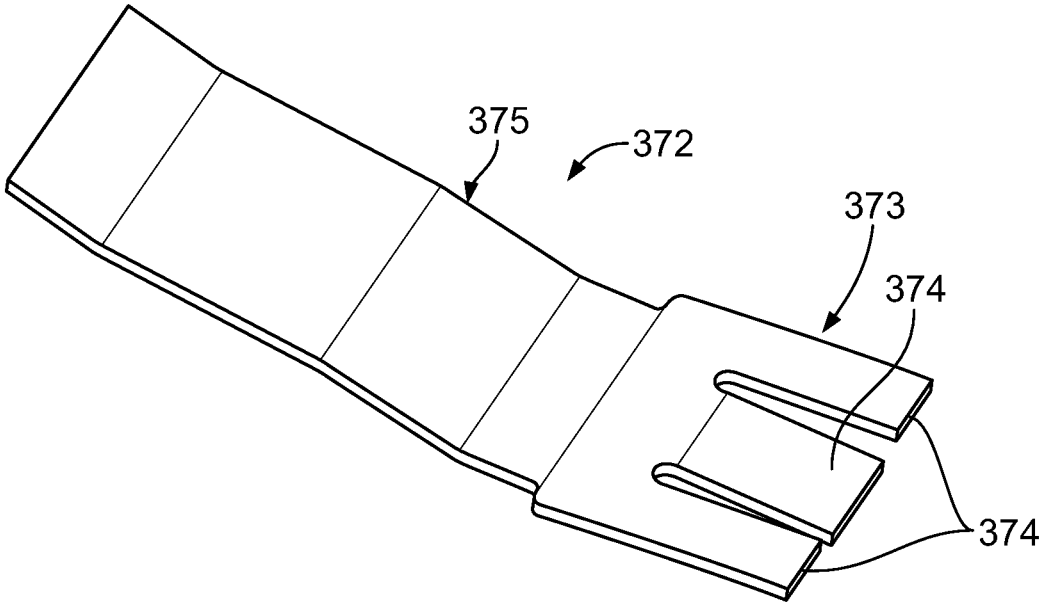
FIG. 8 is a perspective view of an example retaining spring as used in conjunction with a cable seal system and connector as disclosed herein.

FIG. 8 illustrates an example retaining spring 372 as used in conjunction with a cable seal system and connector as disclosed herein and as partially illustrated in FIG. 7 discussed above. A feature of such retaining spring 372 is that it is specially configured for manual installation into and/or removal from connector members without the need for a heat staking operation. In an example, the retaining spring is configured comprising a barbed end 373 made of two outer prongs 374 having a common plane alignment, and a center prong having plane alignment that is different, e.g., below, that of the two outer prongs (with reference to FIG. 7). Moving away from the barbed end 373, the retaining spring has a body 375 that is oriented with an upward departure or bend of one or more angles relative to the plane of alignment for the barbed end 373. In an example embodiment, the body may include two or more sections with different departure angles relative to one another as useful for the purpose of cooperating with the cable terminal to urge the terminal into a desired position within the connector member. In an example, the retaining spring can be formed from a rigid material such as metal and the like, and may be formed by stamping or other manufacturing process as a one-piece construction.

Figure 9A:
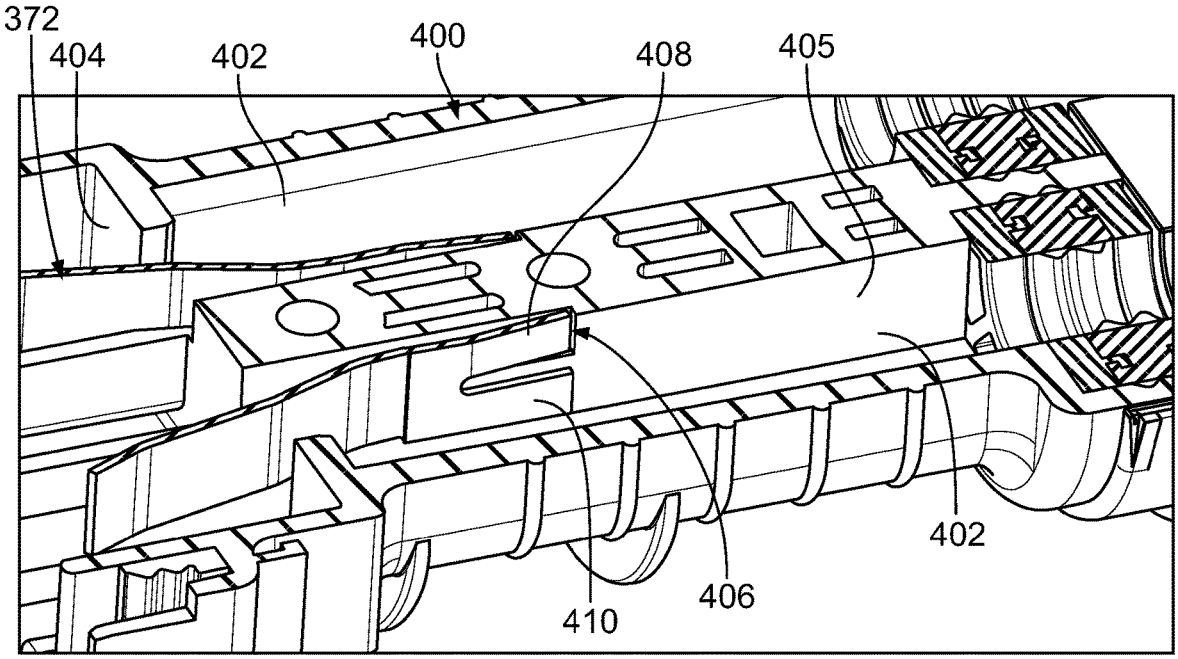
FIGS. 9A and 9B are perspective cross-sectional views of an example connector member comprising the retaining spring of FIG. 8 disposed therein of a cable seal system and connector as disclosed herein.
Figure 9B:
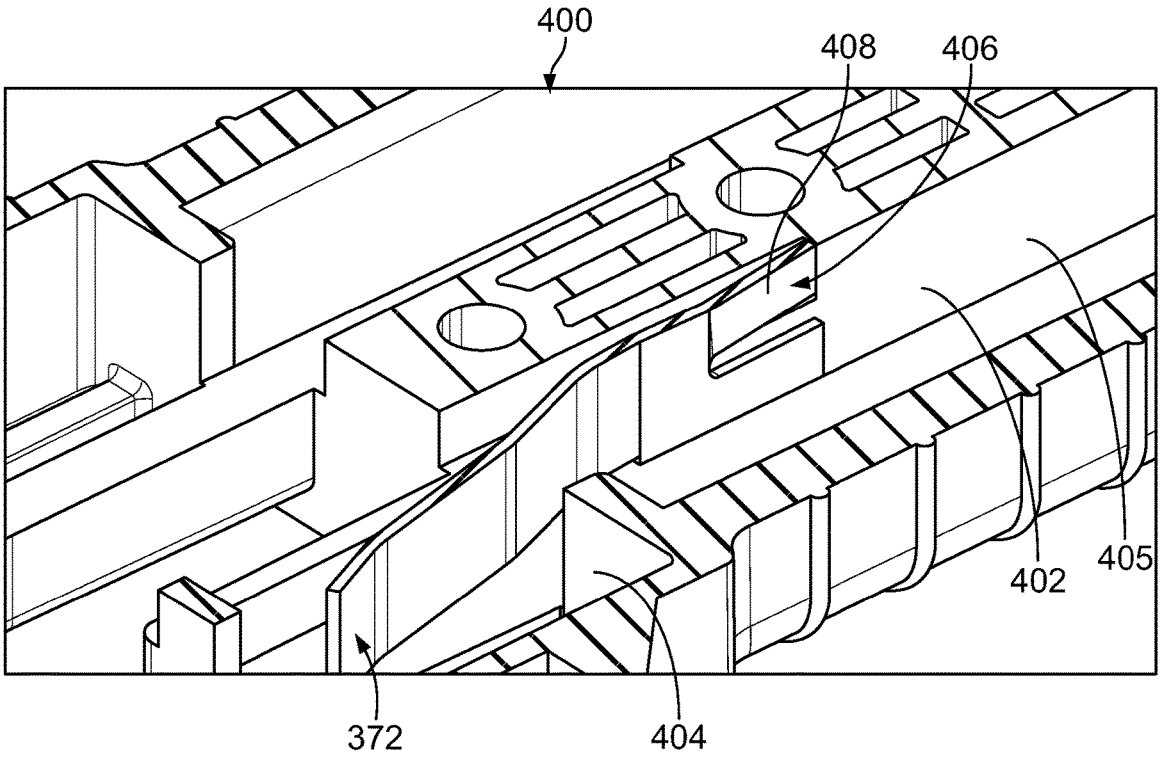

FIGS. 9A and 9B illustrate cross-sectional views of a connector member 400, and specifically the reduced diameter section 402 and connection port 404 of the connector member 400 within which the retaining spring 372 is disposed. As illustrated, a wall portion 405 of the reduced diameter section comprises a recessed slot 406 that is configured to accommodate placement of the retaining spring center prong 408 therein, and by operation of such accommodative placement and a biasing force provided by the two outer prongs 410 against the wall portion 404, mechanically fix placement of the retaining spring 372 within the connector member 400. In an example embodiment, the retaining spring and connector member are desired to provide a barb/latch attachment that provides an audible and/or physical confirmation when the retaining spring is properly seated. The remaining portion of the retaining spring extending from the barbed end deflects in an angular manner into the connection port 404 for purposes of imposing a desired biasing force onto the cable terminal as already discussed above.

Figure 10A:
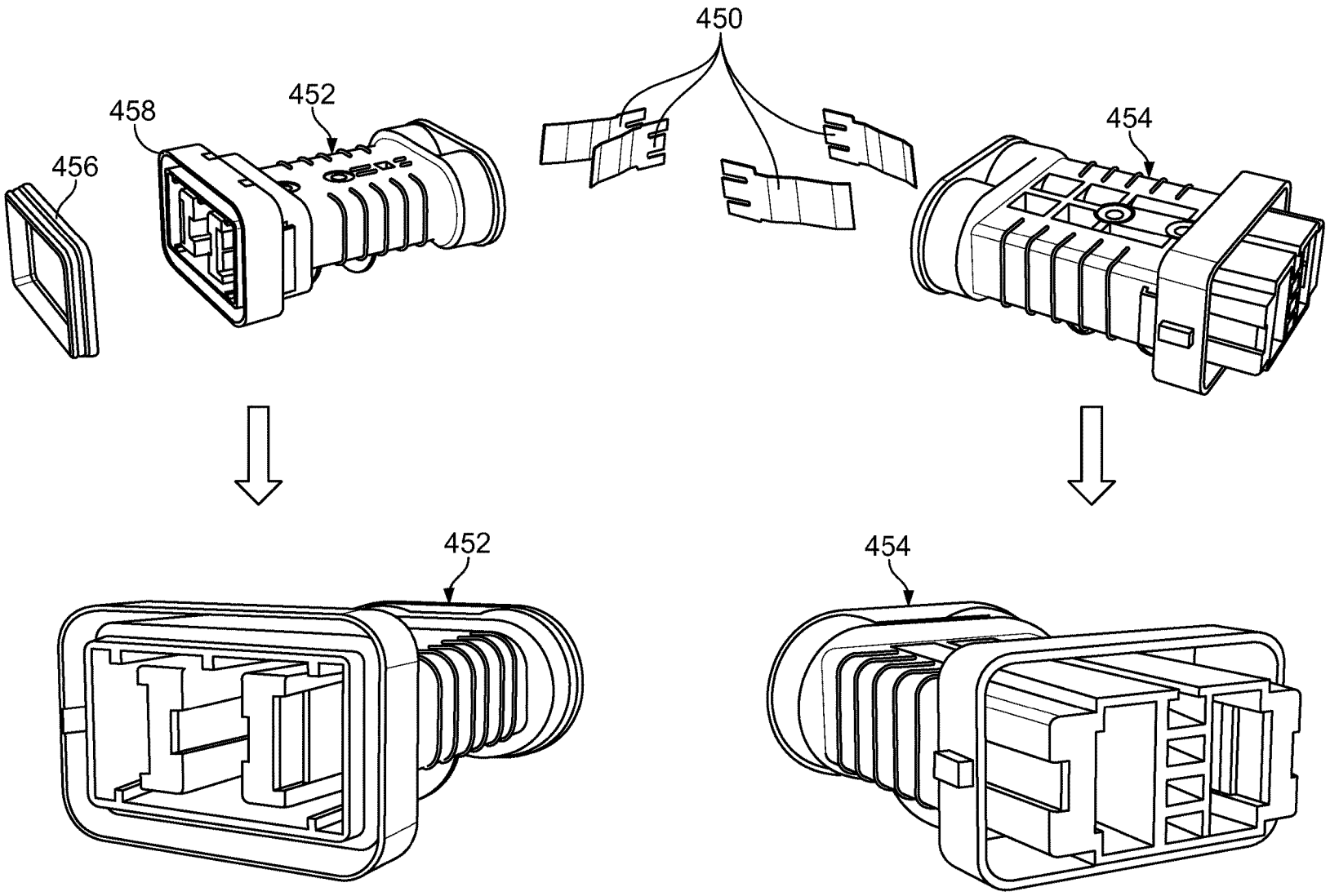
FIGS. 10A to 10C are perspective views illustrating an assembly method for components of an example cable seal system and connector as disclosed herein.
Figure 10B:
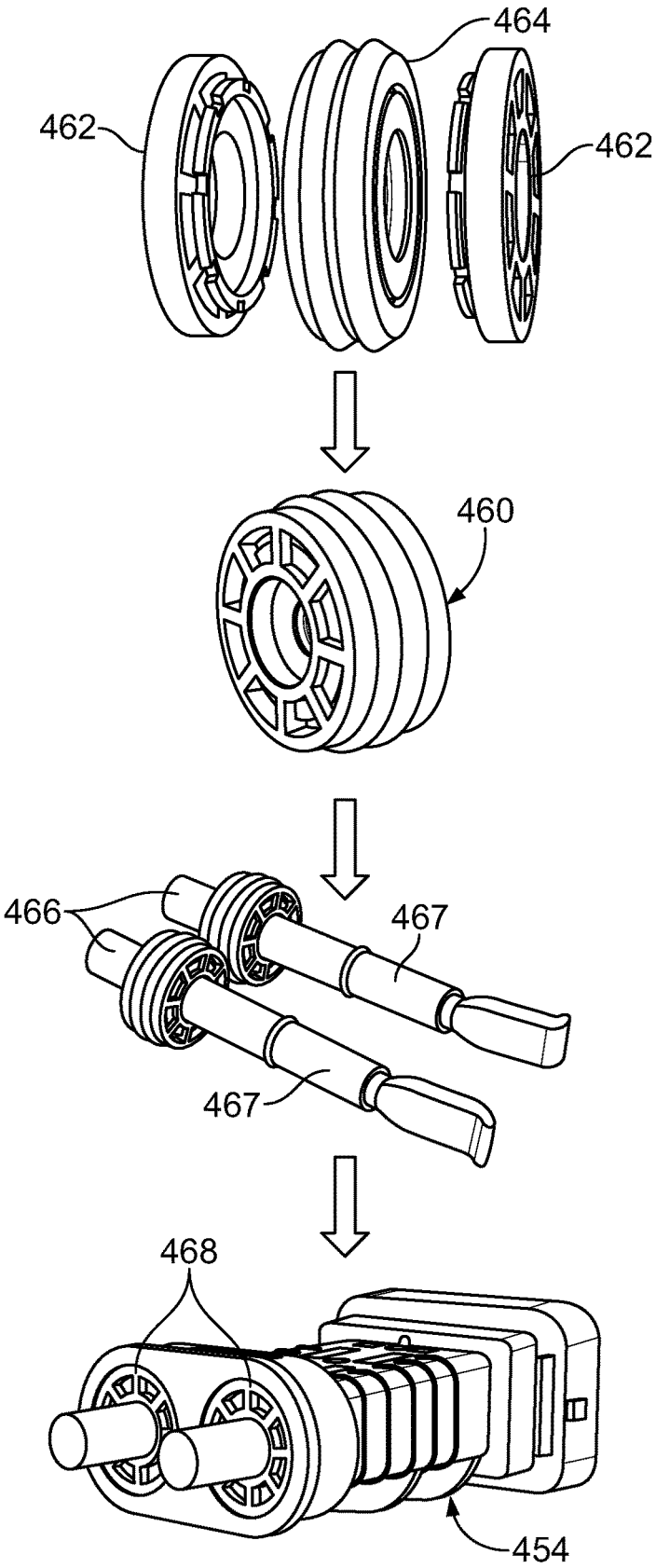
Figure 10C:
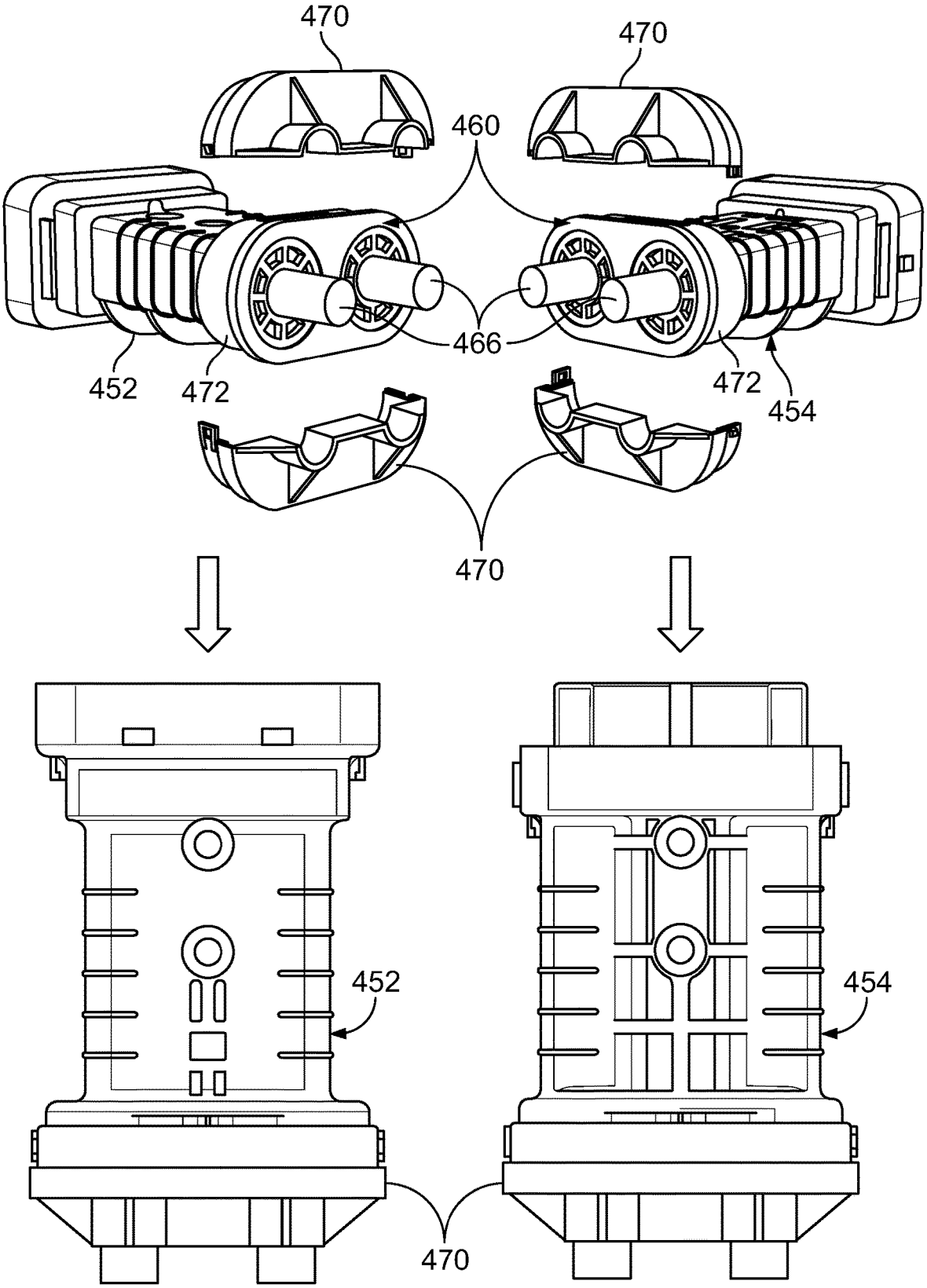

FIGS. 10A to 10C illustrate different points of assembly for an example cable seal system and connector as disclosed herein. With reference to FIG. 10A, the retaining springs 450 are installed into each of the connector members 452 and 454 in the manner described above. Additionally, the peripheral seal 456 may be installed into a connecting end 458 the connector member 452. With reference to FIG. 10B, the sealing members 460 are formed by attaching the guide elements 462 to axial ends of the seal element 464 as discussed above. The sealing members 460 are then slid over an end of the respective cables 466. In an example embodiment, the sealing members 460 are slide over the cable ends before the terminal 467 is applied as the terminal may have a larger outside diameter than the cable that would prevent or impair installation of the seal member after the cable terminal is installed. The cables 466 with their respective sealing members 460 are installed into the recessed openings 468 of the connector member 454 in the manner described above. Referring to FIG. 10C, once the cables 466 and sealing members 460 are installed in the connector members 452 and 454, the retention covers 470 are positioned and installed over the connector member ends 472 to sandwich the connector member ends 472 and cables 466 therebetween, both fixing axial placement of the sealing members 460 and further stabilizing placement of the cables extending from the connector members.

A feature of cable seal systems and connectors as disclosed herein is the configuration and arrangement of the seal assembly members, i.e., the retention cover, the sealing member guide elements, and the connector member, that operate together to provide an improved degree of guidance and positional stability of the cable before, during, and after the cable enters the sealing member to thereby reduce unwanted strain on the cable and the associated possibility of creating a leak path between the seal member and cable as the cable is manipulated, pulled, or otherwise moved relative to the connector member. A further feature of cable seal systems and connectors as disclosed herein is the use of symmetrically configured parts, e.g., the guide elements and retention covers, for ease of manufacturing and assembly efficiency.

The foregoing description and accompanying figures illustrate the principles, preferred embodiments and modes of operation of the cable seal systems and connectors as disclosed herein. However, such cable seal systems and connectors should not be construed as being limited to the particular embodiments discussed above. Additional variations of the embodiments discussed above will be appreciated by those skilled in the art. Therefore, the above-described embodiments should be regarded as illustrative rather than restrictive. Accordingly, it should be appreciated that variations to those embodiments can be made by those skilled in the art without departing from the scope of the cable seal systems and connectors as defined by the following claims.

What is claimed is:

1. A seal system comprising:

a housing having an inside passage for accommodating placement of a cable therein, wherein the passage includes a recessed opening having an inside surface extending axially a partial distance inwardly from an open end of the housing;

a seal member disposed within the recessed opening comprising:

an elastomeric seal element having an inside diameter and an outside diameter, wherein the inside diameter is configured to extend around an outside surface of a cable, and wherein the outside diameter is configured to extend radially and contact the recessed opening inside surface;

a pair of rigid guide elements that are each positioned adjacent opposed axial surfaces of the seal element; and a cover that is connected with the housing open end, the cover having a closed end with an opening disposed therethough to accommodate passage of the cable into the housing, wherein the cover closed end is positioned adjacent the seal member.

2. The seal system as recited in claim 1 wherein the seal member is axially interposed between the cover closed end and a section of the housing to axially fix placement of the seal member within the housing.

3. The seal system as recited in claim 1 wherein the seal element axial surfaces include one or more surface features that complement one or more surface features of the respective rigid guide elements to form an attachment fit therebetween.

4. The seal assembly as recited in claim 1 wherein the seal element outside diameter has a surface feature to provide a leak-tight seal with an adjacent section of the inside surface of the recessed opening.

5. The seal assembly as recited in claim 1 wherein the seal element inside diameter has a surface feature to provide a leak-tight seal with an outside diameter surface of the cable.

6. The seal assembly as recited in claim 1 wherein the cover opening has an axial length that extends outwardly a distance beyond the housing open end to stabilize positioning of the cable relative to the seal member.

7. The seal assembly as recited in claim 1 wherein the cover comprises a first member and a second member that each fit over ½ of the housing open end and that interlock with one another to sandwich the housing therebetween.

8. The seal assembly as recited in claim 1 wherein the guide elements have an annular shape with an inside diameter that is greater than the seal element inside diameter and an outside diameter that is less than the seal element outside diameter.

9. A connector for joining together two or more cables comprising:

first and second connector members that are each configured having first ends with complementary surface features to promote interconnection between the connector members;

one or more cables disposed within each of the first and second connectors;

one or more seal members disposed within second ends of each connector member, each seal member comprising;

a resilient seal element having an inside diameter forming a leak-tight seal with an outside surface of the cable and an outside diameter forming a leak-tight seal with an adjacent surface of the connector member; and a pair of annular rigid guide elements that are each connected with opposed axial surfaces of the resilient seal element, wherein the seal element outside diameter extends radially outwardly a distance from outside diameters of the rigid guide elements;

a cover that is disposed over each connector member second end and that includes one or more cable openings therethrough that are in axial alignment with the respective one or more cables that are disposed in the one or more seal members, wherein the cable openings extend a distance outwardly from the connector member second ends and axially outwardly from the cover, and wherein the cable is in contact with and supported by the cable opening;

wherein each seal member is fixed axially within each connector member second end by contact with the cover.

10. The connector as recited in claim 9 wherein the resilient seal element includes one or more surface features along the inside diameter surface to promote the leak-tight seal with the cable.

11. The connector as recited in claim 9 wherein the resilient seal element includes one or more surface features along the outside surface to promote the leak-tight seal with the connector member.

12. The connector as recited in claim 9 wherein the resilient seal element includes one or more surface features along an axial surface to promote connection with the guide element.

13. The connector as recited in claim 12 wherein each the guide element includes one or more surface features along an axial surface to promote attachment with the resilient seal element.

14. The connector as recited in claim 9 wherein the seal members are disposed within recessed openings that extend axially inwardly a partial distance from each connector second end.

15. The connector as recited in claim 14 wherein the resilient seal element has an outside diameter surface that is sized slightly larger than diameter surfaces of the recessed openings.

16. A method for sealing a cable disposed in a connector comprising the steps of:

placing an annular sealing member over an outside diameter of the cable, the sealing member comprising a pair of rigid guide elements and a resilient seal element interposed axially between the guide elements;

positioning the combined cable and sealing member in a recessed opening of a connector member, wherein the sealing member is disposed adjacent an open end of the connector member, and wherein an outside diameter of the resilient sealing element is in contact with a diameter surface of the recessed opening; and attaching a cover over the connector member open end to fix axial placement of the sealing member in the connector member.

17. The method as recited in claim 16 further comprising forming the sealing member by attaching each of the rigid guide elements to respective opposed axial surfaces of the seal element.

18. The method as recited in claim 16 wherein the sealing element has an inside diameter that is less than an inside diameter of the rigid guide elements, and has an outside diameter that is greater than an outside diameter of the rigid guide elements.

19. The method as recited in claim 16 wherein during the step of positioning, the recessed opening of the connector extends axially a partial distance from the connector open end, and the resilient sealing element includes one or more outside diameter surface features in contact with the diameter surface of the recessed opening.

20. The method as recited in claim 16 wherein during the step of attaching, the cable is disposed within and in contact with an opening through the cover that extends axially a distance from the connector open end and that is in axial alignment with the seal member.

* * * * *